US009004385B2

(12) United States Patent
Leshem et al.

(10) Patent No.: US 9,004,385 B2
(45) Date of Patent: Apr. 14, 2015

(54) SHREDDING MACHINE

(75) Inventors: Yoav Leshem, Kfar-Saba (IL); Rafi Ziv, Ramat-Gan (IL); Zohar Levy, Haifa (IL); Dov Barkay, Ramat-Ishay (IL); Igor Shustorovitch, Tiberias (IL)

(73) Assignee: Re-Pet Ltd., Kfar-Saba (IL)

( * ) Notice: Subject to any disclaimer, the term of this patent is extended or adjusted under 35 U.S.C. 154(b) by 275 days.

(21) Appl. No.: 13/636,779

(22) PCT Filed: Mar. 24, 2011

(86) PCT No.: PCT/IL2011/000276

§ 371 (c)(1),
(2), (4) Date: Jan. 3, 2013

(87) PCT Pub. No.: WO2011/117874

PCT Pub. Date: Sep. 29, 2011

(65) Prior Publication Data

US 2013/0134243 A1 May 30, 2013

Related U.S. Application Data

(60) Provisional application No. 61/316,929, filed on Mar. 24, 2010.

(51) Int. Cl.

| | |
|---|---|
| ***B02C 1/00*** | (2006.01) |
| ***B02C 18/04*** | (2006.01) |
| ***B02C 19/00*** | (2006.01) |
| ***B02C 23/02*** | (2006.01) |
| ***B02C 23/08*** | (2006.01) |
| ***B02C 25/00*** | (2006.01) |

(52) U.S. Cl.

CPC ..... *B02C 18/04* (2013.01); *B02C 19/0093* (2013.01); *B02C 23/02* (2013.01); *B02C 23/08* (2013.01); *B02C 25/00* (2013.01)

(58) Field of Classification Search

USPC ..... 241/100, 262, 283, 94, 99, 270

See application file for complete search history.

(56) References Cited

U.S. PATENT DOCUMENTS

| | | | | |
|---|---|---|---|---|
| 2,046,396 | A * | 7/1936 | Matter et al. | 241/84.4 |
| 2,467,278 | A | 4/1949 | Thompson et al. | |
| 2,660,313 | A | 11/1953 | James et al. | |
| 2,843,331 | A * | 7/1958 | Reeves | 241/198.1 |
| 3,299,802 | A | 1/1967 | Black | |

(Continued)

OTHER PUBLICATIONS

International Search Report and Written Opinion dated Sep. 30, 2011 in corresponding International Application No. PCT/IL2011/000276.

*Primary Examiner* — Faye Francis

(74) *Attorney, Agent, or Firm* — Browdy and Neimark, PLLC

(57) ABSTRACT

A machine for shredding plastic container including a pressing device having a main housing having an interior space, a first opening for feeding container and a second opening for disposing the shredded pieces, a fixed plate position at one end within the housing and having slits arranged in matrix pattern, facing the interior of the housing, and having sharp edges, a movable plate having plurality of blades connected to at least one arm. The movable plate can move along a central axis within the housing and the blades have edges facing the sharp edges of the fixed plate. The containers are placed between the plates, such that when the movable plates moves along the central axis of the housing toward the fixed plate, the blades crash and cut the container into flakes. Pegs protrude from the blades, such that when the arm moves forward, the pegs punch the container.

14 Claims, 6 Drawing Sheets

(56) References Cited

U.S. PATENT DOCUMENTS

| | | | | | |
|---|---|---|---|---|---|
| 4,073,661 | A | | 2/1978 | Buzga et al. | |
| 4,272,032 | A | * | 6/1981 | Hellberg | 241/263 |
| 4,324,325 | A | | 4/1982 | Dewoolfson et al. | |
| 4,600,159 | A | | 7/1986 | Akesson | |
| 4,848,679 | A | * | 7/1989 | Blumer | 241/84 |
| 4,967,626 | A | | 11/1990 | Doster et al. | |
| 5,060,876 | A | * | 10/1991 | Parolisi et al. | 241/263 |
| 5,106,026 | A | | 4/1992 | Baron | |
| 5,172,630 | A | | 12/1992 | Thompson | |
| 5,213,031 | A | | 5/1993 | Hebbert | |
| 5,255,859 | A | | 10/1993 | Peacock et al. | |
| 5,267,496 | A | | 12/1993 | Roach et al. | |
| 5,435,445 | A | | 7/1995 | Dellinger et al. | |
| 5,441,160 | A | | 8/1995 | Dewoolfson | |
| 5,558,284 | A | | 9/1996 | Baumung et al. | |
| 5,560,552 | A | | 10/1996 | Powell et al. | |
| 5,642,661 | A | | 7/1997 | Tu | |
| 5,947,016 | A | | 9/1999 | Repac et al. | |
| 7,546,965 | B1 | | 6/2009 | Parkin | |
| 7,857,249 | B2 | * | 12/2010 | Nanney et al. | 241/271 |
| 7,861,956 | B2 | * | 1/2011 | Hiller, Sr. | 241/30 |
| 7,975,950 | B2 | * | 7/2011 | Ebadian et al. | 241/263 |
| 8,794,559 | B1 | * | 8/2014 | Olliges et al. | 241/243 |
| 2006/0260449 | A1 | | 11/2006 | Okuya et al. | |
| 2008/0223758 | A1 | | 9/2008 | Scheeres et al. | |
| 2009/0249935 | A1 | * | 10/2009 | Kaposi | 83/635 |

* cited by examiner

SHREDDING MACHINE

BACKGROUND

1. Technical Field

The present invention relates to the field of shredding machine, and more particularly, to plastic shredding methods.

2. Background

The known is the art machines for recycling plastic containers which are available to the public enable to collect the containers or shrink them into compact size.

BRIEF DESCRIPTION OF THE DRAWINGS

The present invention will be more readily understood from the detailed description of embodiments thereof made in conjunction with the accompanying drawings of which.

SUMMARY OF THE INVENTION

Figure 1:
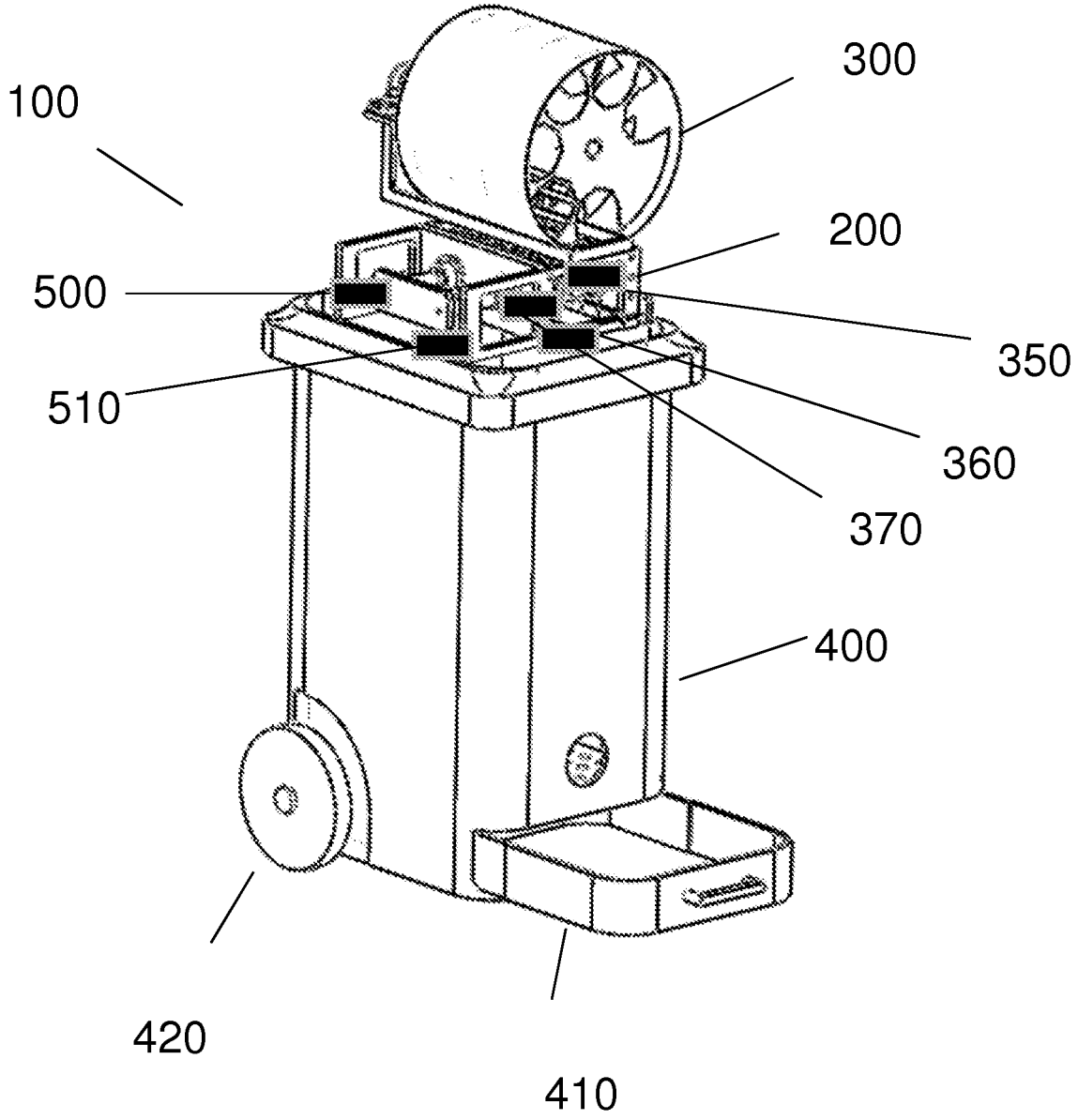
FIG. 1 illustrates the shredding machine design according to some embodiments of the present invention

The present invention discloses a machine for shredding plastic container. The shredding machine comprises a pressing device comprised of: a main housing having an interior space, a first opening for feeding container and a second opening for disposing the shredded pieces, a fixed plate having slits arranged in matrix pattern, said slits having sharp edges, wherein said plate is positioned at one end within the housing and said slits facing the interior space of the housing, a movable plate having plurality of blades connected to at least one arm, wherein said plate is arranged to move along a central axis within the housing and said blades edges facing the sharp edges of said fixed plate where the blades configuration correspond to slits matrix pattern. When operating the machine the containers are placed in-between said movable plate and said fixed plate, such that when the movable plates moves along the central axis of the housing toward the fixed plate, the blades crash and cut or shear the container into flakes of predefined size suitable for recycling.

The machine may further includes sharp pegs protruding from the front line of the blades, such that when the arm moves forward the sharp pegs punch the container, wherein the punching precede the crushing and cutting operation and create pores in the container. The blades may have specific design, were at least part of the blades have rectangular shape having predefined angle and were at least part of the blades are horizontally oriented and at least pert of blades are vertically oriented. The machine design may have the first opening located at the upper surface of the housing, the second opening is located at the bottom surface of the housing and the blade assembly moves along the horizontal axis of the housing.

The machine may further comprise a feeding mechanism for receiving the containers and conveying thereof into the first opening hole. The feeding mechanism may be comprised of circular housing having plurality of compartments, each compartment designed to enclose one container, wherein the upon revolving said circular housing each compartment change it's position, such that at each time one compartment is locate above the first opening, dropping the container through the first opening into the main housing interior space.

The machine may further comprise a container, positioned bellow the second opening. The container may include a pump for vacuuming the flakes from the main housing into the container through the second opening. Optionally the flakes container may include a drawer at the lower end, wherein a plate having perforations is positioned above the drawer, allowing liquid to go through into the drawer.

The shredding machine may be designed as portable machine and may be operate manually using human force. Optionally shredding machine may be designed with electro mechanical mechanism or with hydraulic or pneumatic mechanism.

The shredding machine may further comprise at least one sensor for detecting container properties including at least one of: material type, color or size. The sensor may be located within the main housing for detecting pressure applied on the container through the crushing and cutting operation.

The shredding machine may further comprise door for machine opening arranged to automatically lock the machine in predefined states.

The shredding machine may further comprise a controller and communication module enabling remote supervising of the machine and accumulating data of machine production.

The shredding machine may further comprise a color sensors, said sensors enable separating between different colored plastics to be collected at different sub containers.

The shredding machine may further comprise a computerized module for counting number of shredded containers for each identified user and providing said user with coupons having monetary value corresponding the number of shredded containers.

DETAILED DESCRIPTION

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The present invention discloses a shredding machine for recycling plastic containers. The machine can be designed in different size and fit to different requirements for public or domestic use. When located at public domain, the machine includes containers for storing the shredded pieces and the containers are emptied at predefined periods by service providers, which deliver the material to recycling centers.

FIG. 1 illustrates an integrated view of the shredding machine components in accordance with some embodiments of the present invention. The shredding machine 100 comprises a feeding device 300, a pressing device 200 and flakes container 400. The shredding machine illustrated in FIG. 1 is specifically designed for recycling pet bottles however, the machine according to the present invention can be designed to recycle different types and shapes of plastic containers. The machine may be placed in public or private domain in location accessible to the plurality of users. One possible location may be near by the garbage containers, which is accessible both for the user who whishes to recycle their plastic waste and to the service provider for gathering the flakes and conveying them to recycling centers. The machine may be located at different type vehicles such trains, airplanes or cars.

Figure 2:
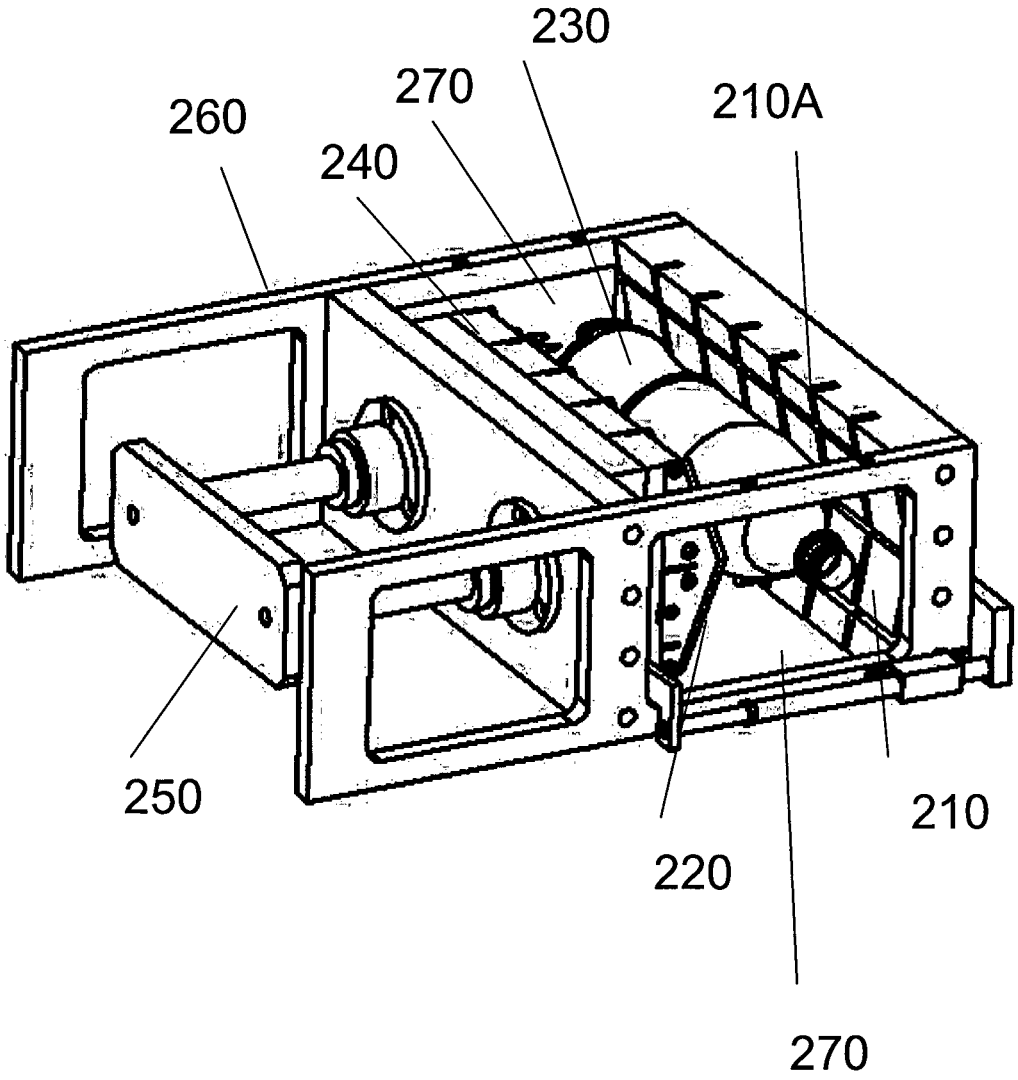
FIG. 2 illustrates the pressing device according to some embodiments of the present invention
Figure 3:
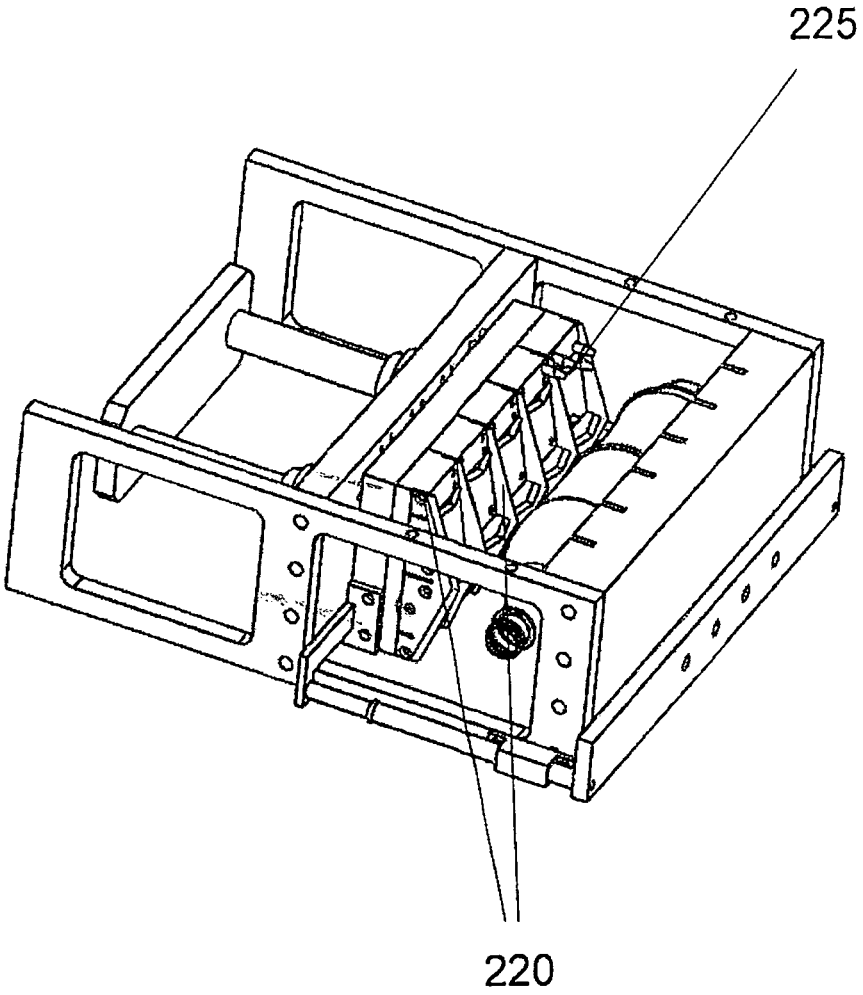
FIG. 3 illustrates the pressing device design according to some embodiments of the present invention

FIGS. 2 and 3 illustrate the pressing device according to some embodiments of the present invention. The pressing device is designed to receive pet bottles 230 through an upper opening 270 of the device housing, shredding the bottles into flakes and dispensing the flakes through a lower opening 280 to the flakes container 400. The bottles are positioned in between a fixed plate 210 and a movable plate 240. The fixed plate 210 includes slits 210A having sharp edges in a matrix pattern. The movable plate 240 is connected to an arm 250 and includes horizontal and vertical blades 220 (see FIG. 3) and sharp pegs 225. The pegs 225 protrude beyond the edges of the blade, such as when the plate 240 is pressed forward toward the fixed plates 210, the pegs first punch holes in the bottles before the blades crush and cut or shear the bottles. The order of actions in the described process has an advantage in shredding process, by releasing the air pressure before the cutting operation. The blades construction and shape is designed for two purposes: cutting the bottles in predefined size suitable for recycling, and efficient processing of the cutting/shearing operation. The triangle shape of the vertical blades has predefined angles between 6 and 10 degrees, such design has advantage in the shearing process. The construction of the blades is further designed to accommodate the slit pattern of the fixed device, such that blades fit into at least part of the slits 210A.

Figure 4:
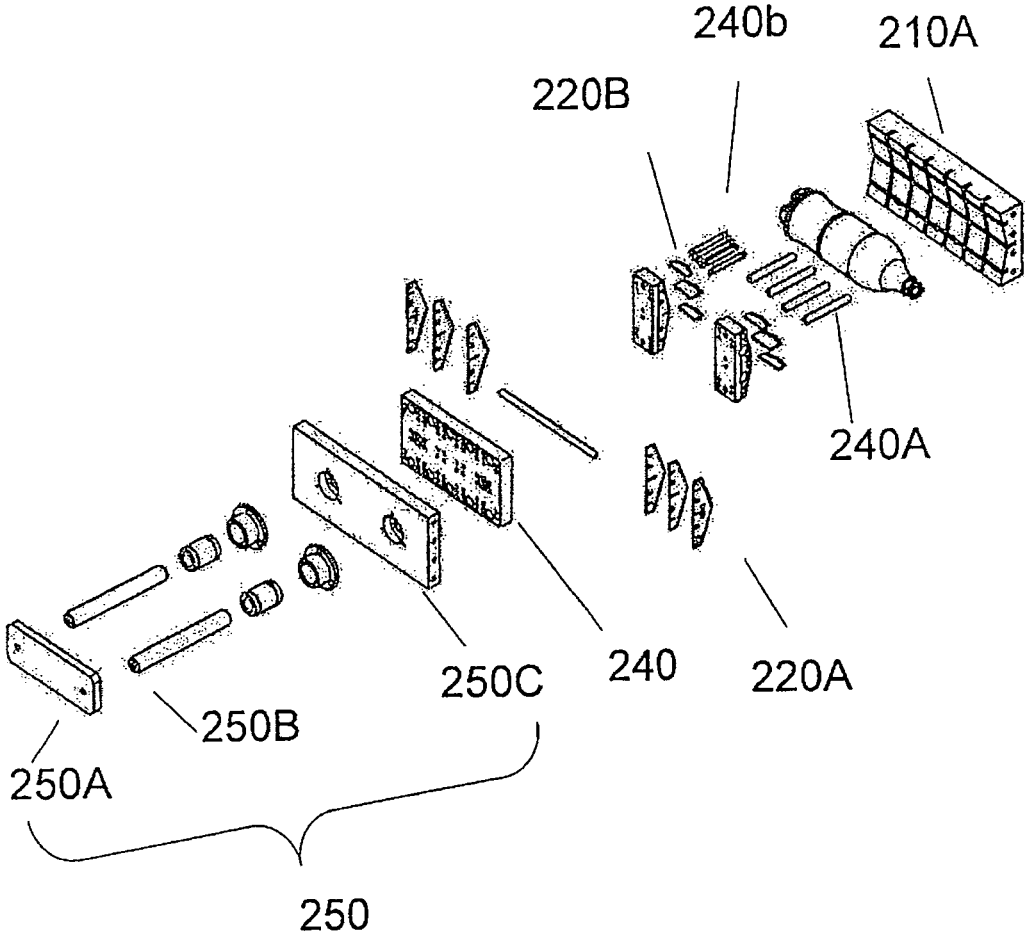
FIG. 4 illustrates the pressing device components according to some embodiments of the present invention

FIG. 4 illustrates the components of the pressing device according to some embodiment of the present invention. The movable plate 240 is connected to an arm structure 250. The arm structure is comprised of a plate 250C, two rods 250C and a pushing plate 250A. The blades' construction includes six vertical blades of triangle shape, six vertical blades and six pegs. The pressing device may be operated by electrical motor or by a mechanical mechanism using hydraulically or pneumatic technologies. Portable machine may have mechanical implementation enabling to be operated by human force.

Figure 5:
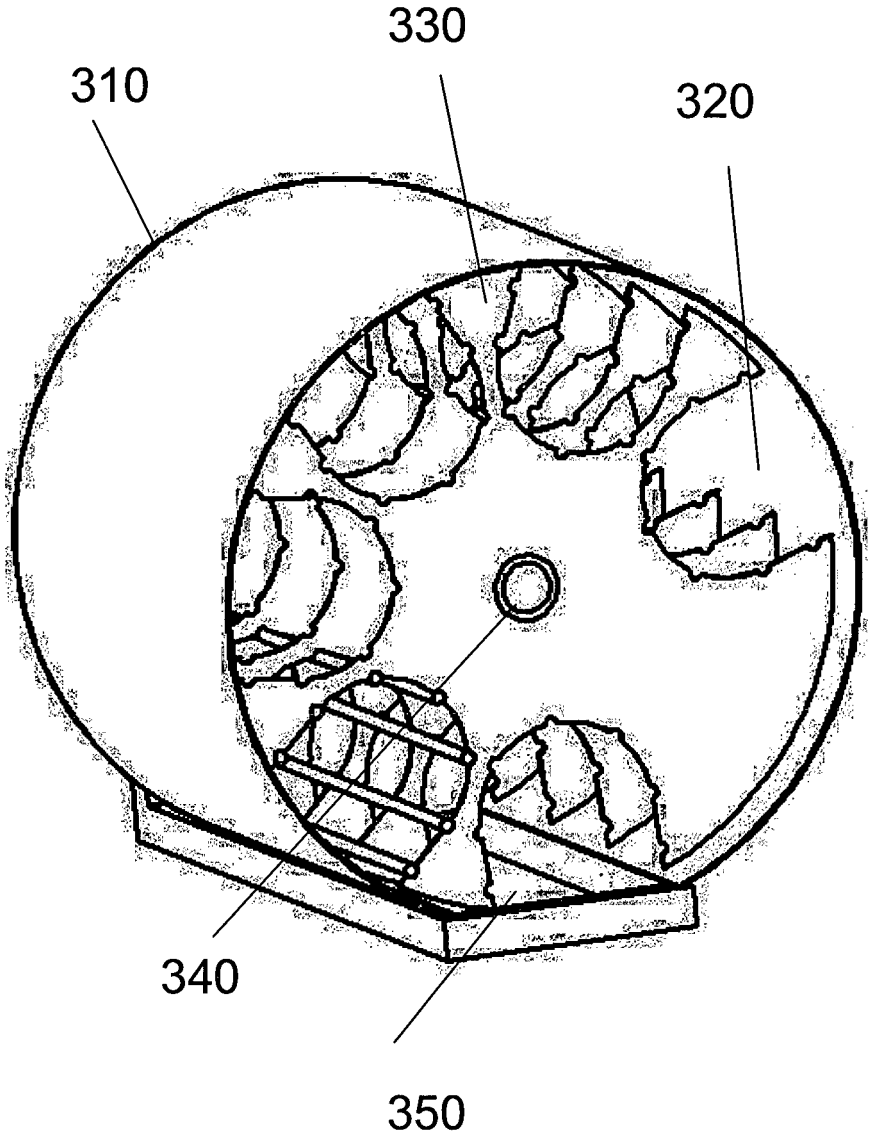
FIG. 5 illustrates the feeding device design according to some embodiments of the present invention

FIG. 5 illustrates the feeding device according to some embodiments of the present invention. The feeding device is comprised of circular housing 310 and structure 330 of six compartments 320. The structure 320 is arranged to rotate around the central axis 340. The bottles can be inserted at each compartment by the user. When rotating the compartments' structure, at each time, one compartment is facing the opening of the feeding device 350. Bottles located at the lower compartment drop through the opening into the housing of the pressing device.

The shredding machine may further comprise at least one sensor 350, 360, 370 for detecting container properties including at least one of: material type, color or size. The sensor may be located within the main housing for detecting pressure applied on the container through the crushing and cutting operation.

According to alternative embodiment of the present invention the feeding device may enable serial input of bottles. The feeding device may be designed as a long hollow sleeve enabling to insert bottles one after the other through an upper opening of the sleeve. The bottles are aggregated at body of the sleeve. The sleeve may include a mechanical opening mechanism enabling to release one bottle at a time into the opening of the pressing device.

Figure 6:
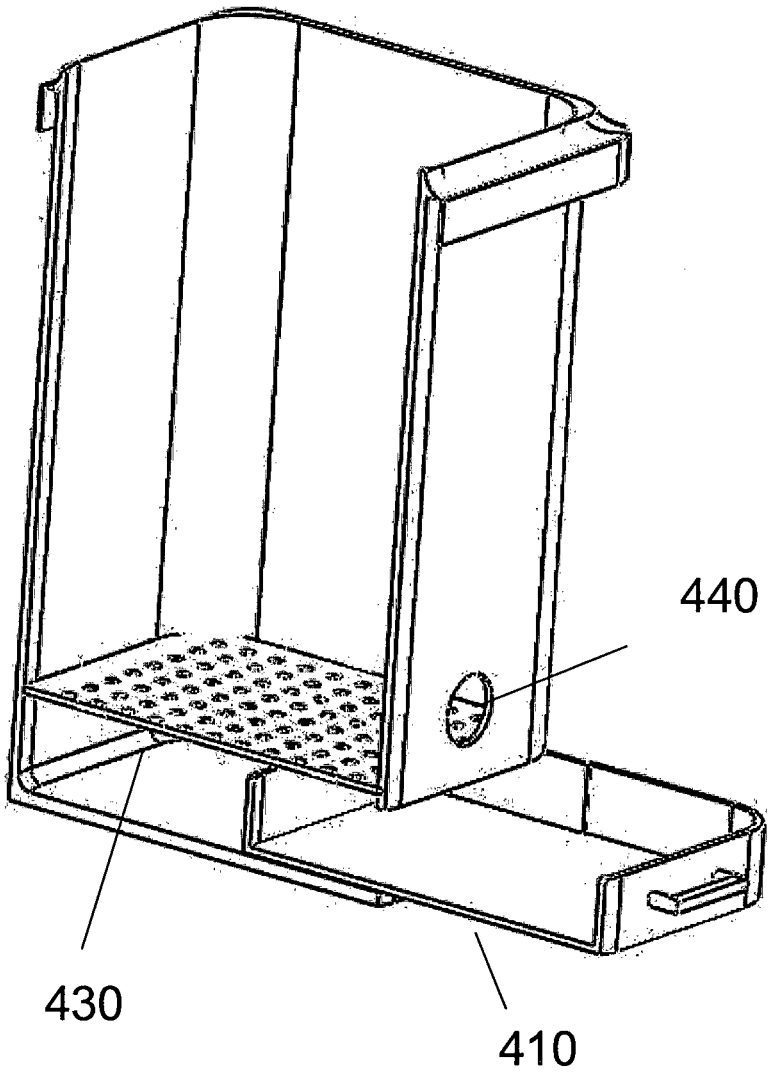
FIG. 6 illustrates the flakes container design according to some embodiments of the present invention

FIG. 6 illustrates the flex container device according to some embodiment of the present invention. The container is designed to store flaxes shredded by the pressing device. Shredding machine located at public domains may have a large container having enough space for storing flaxes of large quantity of bottles. According to some embodiment, the container includes a drainage drawer 410 to collect liquids spilled through the shredding process. The drawer has an upper plate having a plurality of pores for allowing liquids to drain through the pores into the drawer. The container may have a hole 440 at its lower part for evacuating the flaxes from the container. According to some embodiment of the present invention, the container is made of disposable material and is replaced each time the container is full.

According to some embodiments of the present invention the device may include different safety accessories. The machine may include sensors at the feeding device or at the pressing device for detecting different properties of the inserted objects to prevent damage or miss use of the machine. The properties may relate to the material, the size or the color of the inserted objects. A sensor located at the pressing device may detect the pressure applied within the device for preventing hazardous object to damage the machine. Other safety measurements may include a safety door to be operated only with two hands.

According to other embodiments of the present invention it is suggested to include color sensors. Such sensors can be used for separating between different colored plastics and enable to collect each colored type flaxes at different sub containers.

According to a further embodiment of the present invention, the machine may comprise a controller and communication module 500 enabling remote supervising of the machine and accumulating data of machine production. The data accumulation of machine production may be used for planning the schedule of collecting the shredded pieces from the machines scattered at different geographical locations.

According to another embodiment of the present invention, the machine may comprise a computerized terminal 510 for counting the number of shredded containers for each identified user and providing the respective user with coupons having a monetary value corresponding to the number of shredded containers.

According to further embodiment of the present invention the shredding machine may comprise a computerized module 510 for counting number of shredded containers for each identified user and providing said user with coupons having monetary value corresponding the number of shredded containers. The computerized module may include a transmission unit enabling to communication through wired or wireless communication network to a central remote server for accumulating data of user usage and enabling to management of virtual coupon account for the user. The user may access the remote server for to make virtual user or print his accumulated coupons.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not to be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A machine for shredding plastic container, said machine comprising a pressing device comprised of:

a main housing having an interior space, a first opening for feeding container and a second opening for disposing the shredded pieces;

a fixed plate having slits arranged in matrix pattern, said slits having sharp edges, wherein said fixed plate is positioned at one end within the housing and said slits facing the interior space of the housing; and a movable plate having plurality of blades connected to at least one arm, wherein said plate is arranged to move along a central axis within the housing and said blades having edges facing the sharp edges of said fixed plate where the blades configuration correspond to slits matrix pattern;

wherein the containers are placed in-between said movable plate and said fixed plate, such that when the movable plates moves along the central axis of the housing toward the fixed plate, the blades crash and cut the container into flakes having predefined size suitable for recycling, and wherein the movable plate further includes sharp pegs protruding from the front line of the blades, such that when the arm moves forward the sharp pegs punch the container, wherein the punching precede the crushing and cutting operation and create pores in the container.

2. The machine of claim 1, wherein at least part of the blades have rectangular shape having a predefined angle.

3. The machine of claim 2, wherein the predefined angle is in the range between 6 and 10 degrees.

4. The machine of claim 3, further comprising a feeding mechanism for receiving the containers and conveying thereof into the first opening hole.

5. The machine of claim 1, wherein at least part of the blades are horizontally oriented and at least part of blades are vertically oriented.

6. The machine of claim 1, wherein the first opening is located at the upper surface of the housing, the second opening is located at the bottom surface of the housing and the blade assembly moves along the horizontal axis of the housing.

7. The machine of claim 6, wherein the feeding mechanism is comprised of circular housing having plurality of compartments, each compartment designed to enclose one container, wherein when said circular housing revolves, each compartment changes position, such that at each time one compartment is located above the first opening, dropping the container through the first opening into the main housing interior space.

8. The machine of claim 1, further comprising a flakes container, positioned bellow the second opening.

9. The machine of claim 8, wherein the container further comprise a drawer at the lower end, wherein a plate having perforations is positioned above the drawer, allowing liquid to go through into the drawer.

10. The machine of claim 1, further comprising at least one sensor for detecting container properties including at least one of: material type, color or size.

11. The machine of claim 1, further comprising at least one sensor located within the main housing for detecting pressure applied on the container through the crushing and cutting operation.

12. The machine of claim 1, further comprising a controller and communication module enabling remote supervising of the machine and accumulating data of machine production.

13. The machine of claim 1, further comprising a color sensors, said sensors enable separating between different colored plastics to be collected at different sub containers.

14. The machine of claim 1, further comprising a computerized module for counting number of shredded containers for each identified user and providing said user with coupons having monetary value corresponding the number of shredded containers.

* * * * *